United States Patent [19]

Standring

[11] Patent Number: 4,795,333

[45] Date of Patent: Jan. 3, 1989

[54] ROTARY FORGING

[75] Inventor: Peter M. Standring, West Bridgford, England

[73] Assignee: National Research Development Corporation, London, England

[21] Appl. No.: 13,784

[22] Filed: Feb. 12, 1987

[30] Foreign Application Priority Data

Feb. 14, 1986 [GB] United Kingdom ..... 8603686

[51] Int. Cl.[4] ..... B22F 3/00

[52] U.S. Cl. ..... 425/78; 425/418; 425/429; 264/211.1; 72/67; 72/406

[58] Field of Search ..... 425/77, 78, 329, 330, 425/218, 264, 267, 268, 425, 429, 418, 150, 141, 381.2; 72/67, 406; 264/211.1

[56] References Cited

U.S. PATENT DOCUMENTS

| | | | |
|---|---|---|---|
| 1,839,056 | 12/1931 | Short | 264/120 |
| 2,830,320 | 4/1958 | Geppert | 425/422 |
| 3,151,968 | 10/1964 | Wallar | 425/418 |
| 4,077,811 | 3/1978 | Burman | 148/11.5 F |
| 4,313,332 | 2/1982 | Penny et al. | 72/406 |

FOREIGN PATENT DOCUMENTS

| | | | |
|---|---|---|---|
| 617126 | 7/1978 | U.S.S.R. | 72/406 |
| 1183245 | 10/1985 | U.S.S.R. | 72/67 |

*Primary Examiner*—Charles Hart

*Attorney, Agent, or Firm*—Cushman, Darby & Cushman

[57] ABSTRACT

Rotary forging of a component from powder is accomplished in a single forging operation without any sintering or other processing by firstly pressing the powder in a closed die situation to produce an initial compressed form and then subjecting this compressed form to a rotary forging process.

10 Claims, 4 Drawing Sheets

ROTARY FORGING

BACKGROUND OF THE INVENTION

1. Field of the Invention

The present invention relates to rotary forging and more particularly to apparatus and method for the forging of components from powder.

2. Description of the Prior Art

A known rotary forging machine is described in British Pat. No. 2,041,268B, in which a solid workpiece or blank is deformed by a rotary forging process to a shape determined by a die in which the blank is initially placed. Such a process is acceptable when starting with a solid workpiece or with a blank.

The known process and machine has not proved successful in forming an article directly from powder. The known method for forming an article from powder is to firstly obtain a preform blank by sintering or pressing in a standard press, sintering and then to transfer the preformed blank to the rotary forging machine as above described. This is extremely time consuming since it requires two separate pressing operations and a transfer operation between presses.

SUMMARY OF THE INVENTION

It is an object of the present invention to provide an apparatus and a method for rotary forging components from powder in a single press.

According to the present invention, there is provided an apparatus for producing a component from powder by rotary forging including means for holding a quantity of powder to be made into the component, means for pressing the quantity of powder in a closed die situation to produce an initial compressed form and means for subjecting the initial compressed form to a rotary forging process to produce a final component.

Preferably the apparatus includes an upper die of generally conical shape, and a lower die of complex construction, the lower die having an external wall member which is movable to allow the powder to be initially compressed.

Preferably the apparatus includes means for moving a punch incorporated within the lower complex die upwardly towards the upper die such that in its lower position the cavity formed by the external wall member may be filled with powder, the external wall member being displaced downwardly relative to the punch when the closed die pressing operation is being performed.

In a particular embodiment the upper die is cone shaped, the cone having an angle of 30°.

The apparatus preferably includes control means for controlling the sequential movements of the dies. The upper die is preferably held in a fixed substantially vertical position during the initial closed die pressing situation the lower die being forced upwardly under a position or pressure control to a first limit position, the upper die then being controlled to nutate in a predetermined manner to a desired angle to achieve the rotary forging action.

Preferably both the upper and lower dies spin about their longitudinal axes.

The present invention also provides a method of producing a component from a powder mixture including the steps of initially compressing the powder in a press to achieve a low density component and then subjecting the low density component to a rotary forging action the steps being carried out sequentially in the same press.

BRIEF DESCRIPTION OF THE DRAWINGS

Embodiments of the present invention will now be described with reference to the accompanying drawings in which.

DETAILED DESCRIPTION OF THE PREFERRED EMBODIMENT

Figure 1:
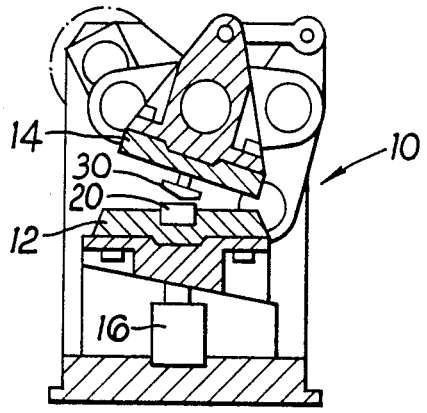
FIG. 1 shows in schematic form a side elevation a press in accordance with the present invention.
Figure 2:
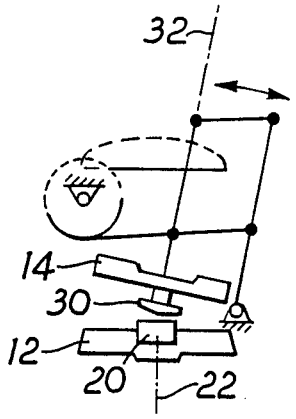
FIG. 2 shows schematically the pivot action of the press of FIG. 1.

With reference now to FIGS. 1 and 2, the press 10 has a platform 12 for mounting a lower die 20 and an upper member 14 for mounting an upper die 30.

The lower platform 12 may be raised in a controlled manner by a hydraulic ram 16 controlled by a predetermined programme held on punch tape or other computerised storage means (not shown).

The upper member 14 can be caused to rotate as shown in FIG. 2 to provide nutation movement for the upper die 30 relative to the lower die.

Both upper and lower dies may be rotated (or spun) about their respective axes 22, 32, (by means not shown) whilst still retaining a required pressure between the dies.

Figure 3:
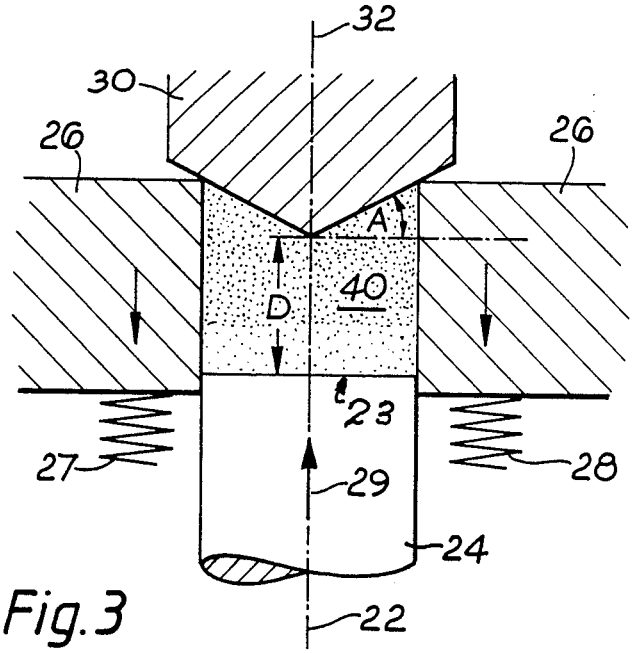
FIG. 3 shows in greater detail the upper and lower dies in a first position.

With reference now to FIG. 3 the dies are shown in greater detail. The upper die 30 is cone shaped and in a practical embodiment the angle A is between 0°–30°.

The lower die 20 is complex, having a centre punch member 24 which is driven upwards by ram 16 and a spring loaded co-operating wall member 26 which is movable against springs 27, 28 relative to punch member 24.

In use, platform 12 and hence die 20, are lowered to an open die situation wherein powder 40 is poured into the die cavity formed by punch member 24 and wall member 26.

In a first pre-pressing operation lower die 20 is then raised to the position shown in FIG. 3 wherein upper conical die 30 with its axis coincident with the lower die axis closes the open cavity.

Figure 4:
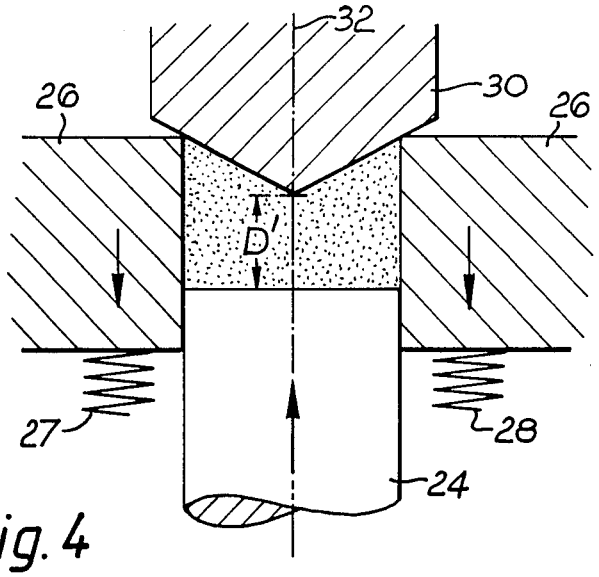
FIG. 4 shows in greater detail the upper and lower dies in a second intermediate position.

Punch member 24 is then forced upwardly as shown by arrow 29 towards die 30 which is fixed from vertical movement. The distance D between the dies is closed to a distance D′ squeezing powder 40 until it is compressed in an initial operation to a position shown in FIG. 4 wherein D is reduced to D′.

The axis 32 of die 30 is then nutated by an angle B and die 20 and thereby the powder 40 is rotated as shown by arrows C. Upper die 30 is rotated as shown by arrow C'. The hydraulic ram 16 is moved upwardly in a controlled gradual manner until distance D' is reduced to the final width D" of the finished component. Springs 27, 28 are progressively compressed by die 30 until the final component width D" is reached.

The distances D, D' and D" are chosen such that with a given powder the distance D provides a sufficient volume to hold the loose powder; the distance D' is such that the powder is partially compressed to form a low density component which will not substantially deform when the die 30 is nutated and the rotary forging is commenced. Distance D" is set such that the required density of finished component can be achieved. Densities in excess of 98% are achievable by this apparatus and method.

The wall 26 of die 20 may have the shape of any desired component, e.g. gear teeth and the top 23 of punch 24 may also have a desired shape. Thus complex shaped components may be produced from powder material.

Figure 5:
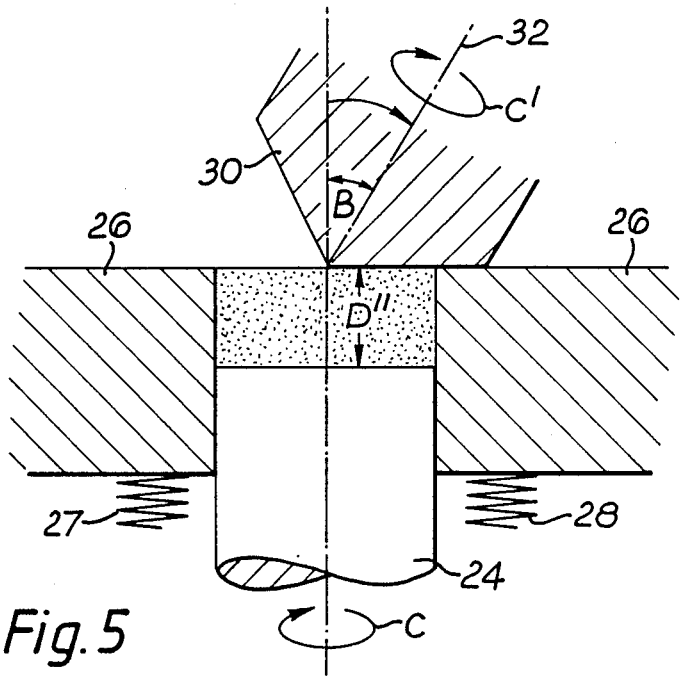
FIG. 5 shows in greater detail the upper and lower dies in a final position.
Figure 6:
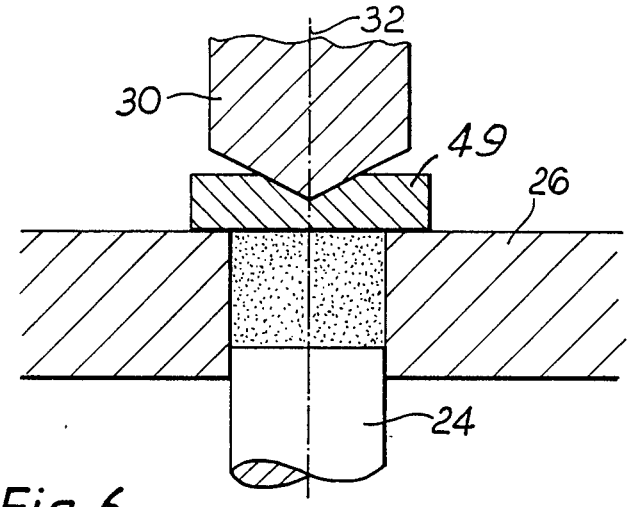
FIG. 6 shows an alternative apparatus for achieving the initial compaction process.

With reference now to FIG. 5 a flat die 49 preferably with a recess 52 for the cone shaped upper die 30 may be placed between the upper die and the powder 40 during the initial compaction process.

Rotary forging/compaction could then take place with a fixed angle of inclination, since the flat die 49 will give the required closed die compaction. In this case the nutation would not contribute to the powder compaction which could be disadvantageous but may be possible for certain component geometries.

Figure 7:
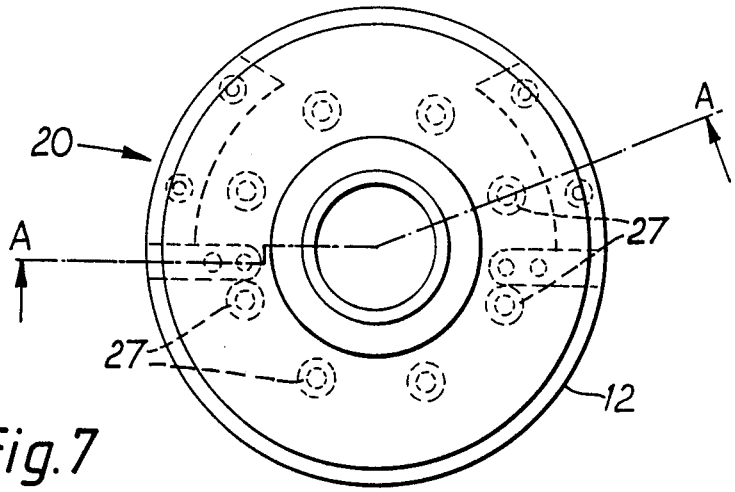
FIG. 7 shows a practical die set in plan view in greater detail.
Figure 8:
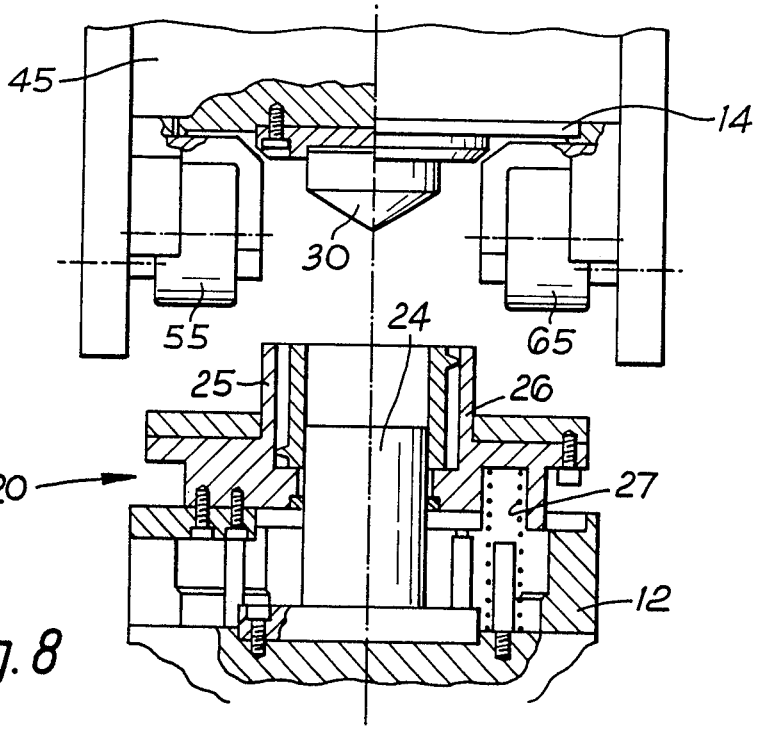
FIG. 8 shows the die set of FIG. 7 in greater detail in cross-sectional elevation along line A—A.

With reference to FIGS. 7 and 8, the complex die 20 and the mounting for the upper die 30 are shown in greater detail for a practical embodiment. Parts performing the same functions are given the same reference numerals as in FIGS. 1 to 5.

The powder materials may be for example aluminium, aluminium alloy, copper, iron, steel or bronze, with a particle size of from dust to 50 μm.

Instead of a spinning operation as indicated by arrows C, C' the same effect can be achieved by using a nutation-precession motion following the initial closed die pressing operation.

The sequence of operation is therefore in an exemplary practical embodiment to fill the die with aluminium alloy powder, compact the powder with a force of approximately 1 tonne per square centimetre followed by the nutation and rolling out operation or by the rotary forging operation performed by nutation and precession. The densities achieved are approximately 99% for steel powder and 99.9% for aluminium.

The dimensions D are dependent on the "tap" density of the powder. Dimensions D' and D" are dependent on the Mass/Volume/Density relationship which is required. The hydraulic ram ascent is a function of the "bite" per revolution or oscillation which the powder compact can accept.

A typical component produced by the apparatus of FIGS. 7 and 8 would be for example a gear wheel or a pump rotor or similar.

Figure 9:
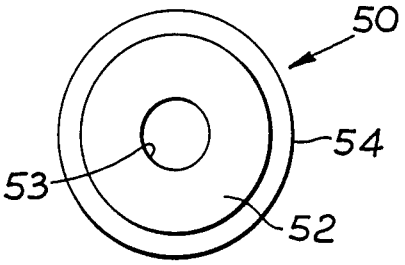
FIG. 9 shows a typical component produced by the die set of FIGS. 7 and 8 in plan view.
Figure 10:
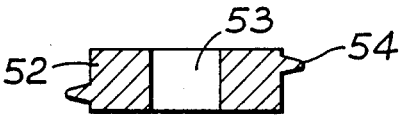
FIG. 10 shows the component of FIG. 8 in cross-section.

A typical pump rotor 50 is shown in FIGS. 9 and 10 and is a circular part 52 of 45 mm diameter and 20 mm thick having a centrally located bore 53 of 16 mm diameter coincident with the axis of the 45 mm diameter surface. The displacement capabilities of the rotor are produced by an integrally formed spiral blade 54 which extends 5 mm beyond the 45 mm diameter surface 52 and progresses in a single helix around the part. The blade is a re-entrant feature in a die body and once formed cannot be pressed axially out of the die. In the forming of this part a three piece segmental die is employed which can be split axially after compaction to facilitate part removal. The stages required to produce such a part from aluminium alloy powder to a final density are given below.

FIGS. 7 and 8 show a typical powder compaction die set for rotary forging of such an item as shown in FIGS. 9 and 10 but not drawn to scale. Item 24 is a centrally located punch attached to an upstroking ram. Item 25 is a floating die body mounted co-axially on item 24 and supported on springs. Item 30 is a dual opposed upper conic doe positioned vertically above items 24 and 25 and sharing the same centre line. Item 45 is a block mounted in trunnions (not shown) the horizontal axis of which passes through the vertex of the upper die. In operation this block is caused to rotate about the trunnion axis between angles zero and 45 degrees from the vertical. Items 55 and 65 are rollers which are adjustable both axially and horizontally prior to a forming operation. Their role is to produce and maintain a minimum clearance between the surface of the upper die and lower die cavity during powder compaction.

The part volume and powder mass are calculated for the production of a component of given final density.

Powder is then weighed and placed in the die set whilst ensuring its reasonably uniform distribution within the die cavity.

For the component specified above for a final compactment of 99% density 80 grammes of aluminium powder is required.

With both die axes coincident the upstroking ram is actuated and simultaneously both upper and lower dies are caused to rotate at typically 100 r.p.m.

Die closure continues until the rollers 55 and 65 contact the flange 25. The relationship of rollers to flange is designed to ensure a minimum die gap exists between the conic surface of the upper die 30 and the inner surface of the lower die cavity 25.

On achieving contact between the rollers and flange further upward movement of the ram causes the punch 24 to move upwards relative to the die body 24 which accommodates this by movement against its supporting springs 27. This causes a reduction in the die cavity volume available for the powder mass.

Termination of the uniaxial compaction phase is reached when the partially consolidated powder mass which occupies the space above the horizontal plane passing through the vertex of the upper die has a volume equal to the porosity remaining in the space beneath that plane.

Termination of the upstroking ram movement is normally achieved using a 'dead stop' arrangement for example by a limit switch (not shown) with total compaction loads up to this point during the manufacture of a pump rotor not exceeding 250 KN force.

At this stage the axis of the upper die 30 is caused to rotate about the axis of the trunnions until a lowest generator on the surface of the conic die lies in the horizontal plane.

Simultaneous with this motion the two rollers 55 and 65 push down on the die body flange and are so positioned as to produce a vertical component of downward movement identical to that of the conic die lowest generator as it moves toward the horizontal plane, thus maintaining the minimum die surface clearance.

It is this second phase, termed the 'nutation phase' which depresses the die body relative to the centre punch thus reducing the volume space available for the powder mass to that which would accommodate only fully dense material.

Typical conic die angles employed in the production of a pump rotor are between 5 to 10 degrees base angles. Nutation rates employed are between 0.5 degree per revolution of the spindles to 2 degrees per revolution.

It is known that smaller cone angled dies require larger forces in the nutation phase than do dies having larger cone angles.

In the same manner smaller nutation rates produce smaller nutation forces than do larger nutation rates. In all cases the nutation force required to consolidate the powder in this example in the nutation phase never exceeds a value of 12 KN. Tests have shown that the force required to achieve the same densification by conventional uniaxial compaction are over thirty times higher than those produced by rotary compaction. Once the nutation angle is equal to the cone angle of the die (the lowest generator of the die is in the horizontal plane) further axial movement between the die and workpiece is stopped and a short roll-out period of about five cycles is allowed prior to main ram descent and the upper die nutation angle returning to zero.

Ejection of the compact is achieved in known manner for a split die by pushing the spring loaded die body downwards with respect to the fixed centre punch thus releasing the split dies in which the part had been formed. The part is then removed from the dies and the process repeated.

Actuation of the system described above is by standard components comprising servo hydraulic means with limit switches, programmable logic controller and desk top micro computer interfaced to provide the operating system for fully automated manufacture. These items are well known in automated forging systems and will therefore not be described in any greater detail.

To initiate a forging cycle a manual input switches the hydraulics to power up the main ram. At a predetermined displacement (registered on a displacement transducer) computer software is initiated to control the servo hydraulic systems which control the: spindle speed of both dies, main ram movement and nutation motion. Basic switching functions and status light indicators are controlled via the programmable controller. The computer is disengaged when the main ram descends below a predetermined value of linear displacement recorded by the displacement transducer.

I claim:

1. Apparatus for directly producing a component from loose powder by rotary forging including:

first die means for holding a quantity of loose powder to be made into the component, second die means for pressing the quantity of loose powder in a closed die situation to produce an initial comprssed form, and means for tilting the second die means relative to the first die means to automatically sequentially subject the initial compressed form, while it is still held within said first die means to a rotary forging process which includes progressively tilting the axis of the first die means with respect to the axis of the second die means to produce a final component.

2. Apparatus as claimed in claim 1 in which the second die means includes an upper die of generally conical shape, and the first die means includes a lower die of complex construction, the lower die having an external wall member which is movable to allow the powder to be initially compressed.

3. Apparatus claimed in claim 2 in which the apparatus includes means for moving the lower complex die of said first die means upwardly towards the upper die such that in its lower position the cavity formed by the external wall member may be filled with powder, the external wall member being displaced downwardly relative to the rest of the die when the closed die pressing operation is being performed.

4. Apparatus as claimed in claim 2 in which the upper die is cone shaped, the cone having an angle between 0°-30+.

5. Apparatus as claimed in claim 2 or 3, including control means for controlling the sequential movement of the dies.

6. Apparatus as claimed in claim 5 in which the control means is operative to hold the upper die in a fixed substantially vertical position during the initial closed die pressing situation, the lower die being forced upwardly under a position control to a first limit position, the upper die then being controlled by the control means to nutate in a predetermined manner to a desired angle to achieve the rotary forging action.

7. Apparatus as claimed in claim 6 in which both the upper and lower dies spin about their longitudinal axes.

8. A method of producing a component from a loose powder mixture including the steps of:

initially compressing the powder in a press between first and second die apparatus to achieve a low density component, and then subjecting the low density component to a rotary forging action, the steps being carried out sequentially in the same press and wherein an axis of the first die is progressively tilted with respect to an axis of the second die to achieve the rotary forging action.

9. Apparatus as claimed in claim 5 in which the control means is operative to hold the upper die in a fixed substantially vertical position during the initial closed die pressing situation, the lower die being forced upwardly under a pressure control to a first limit position, the upper die then being controlled by the control means to nutate in a predetermined manner to a desired angle to achieve the rotary forging action.

10. Apparatus as claimed in claim 4, including control means for controlling the sequential movement of the dies.

* * * * *

UNITED STATES PATENT AND TRADEMARK OFFICE

CERTIFICATE OF CORRECTION

PATENT NO. : 4,795,333

DATED : January 3, 1989

INVENTOR(S) : Peter M. STANDRING

It is certified that error appears in the above-identified patent and that said Letters Patent is hereby corrected as shown below:

Claim 1, Col. 6, line 6, change "first" to -- second --;
line 7, change "second" to -- first --.

Signed and Sealed this

Twenty-fourth Day of September, 1991

*Attest:*

HARRY F. MANBECK, JR.

*Attesting Officer*

*Commissioner of Patents and Trademarks*